US005371914A

United States Patent [19]

Mallory et al.

[11] Patent Number: 5,371,914

[45] Date of Patent: Dec. 13, 1994

[54] WINDOW CLEANING DEVICE

[75] Inventors: George T. Mallory, Blenheim; Richard McFadden; Gary Stover, both of Chatham; Robert L. Smith, Charing Cross, all of Canada

[73] Assignee: Mallory Industries, Inc., Blenheim, Ontario N0P 1A0, Canada

[21] Appl. No.: 150,233

[22] Filed: Nov. 5, 1993

Related U.S. Application Data

[63] Continuation of Ser. No. 851,731, Mar. 16, 1992, abandoned.

[51] Int. Cl.[5] ..... A47L 1/08

[52] U.S. Cl. ..... 15/121; 15/244.3

[58] Field of Search ..... 15/121, 147.1, 147.2, 15/228, 244.1, 244.2, 244.3

[56] References Cited

U.S. PATENT DOCUMENTS

| | | | |
|---|---|---|---|
| 2,915,768 | 12/1959 | Hall | 15/244.1 |
| 3,353,203 | 11/1967 | Ginter | 15/244.1 |
| 3,366,988 | 2/1968 | Menkin | 15/244.1 |
| 3,406,420 | 10/1968 | Siemund | 15/121 |
| 3,783,469 | 1/1974 | Siemund | 15/121 |
| 4,155,139 | 5/1979 | Corcoran | 15/244.1 |

FOREIGN PATENT DOCUMENTS

| | | | |
|---|---|---|---|
| 0074525 | 3/1983 | European Pat. Off. | 15/121 |
| 333543 | 7/1903 | France | 15/244.1 |
| A017656 | 10/1913 | France | 15/147.2 |
| 609710 | 2/1935 | Germany | 15/244.2 |

*Primary Examiner*—David A. Scherbel
*Assistant Examiner*—Randall E. Chin
*Attorney, Agent, or Firm*—Cohn, Powell & Hind

[57] ABSTRACT

A window cleaning device of the type having a handle, a head attached to the handle and a sponge mounted in a longitudinal channel in the head of the washer is provided. A net-like web envelops the sponge. The cleaning device includes an improved stiffener having an elongate body provided with a pair of shoulders extending along the body on both sides thereof. A plurality of protrusions are integrally formed with and extend outwardly from the shoulders on both sides of the elongate body. The stiffener has a pair of flanges one located at each end of the elongate body for locating the body in the channel and preventing movement of the body in the channel. The protrusions act to compress multiple portions of the sponge between the ends of protrusions and the channel walls which creates a plurality of highly compressed areas at these points adjacent less compressed areas between the highly compressed areas into which excess sponge can flow. The action of the protrusions to grip the sponge on the interior thereof provides a firm anchor so that the sponge cannot be removed except by dislodging the stiffener from the channel. The highly compressed area portions of the sponge are forced through the perforations in the web thereby creating a locking effect between the sponge and web, which provides increased gripping strength.

15 Claims, 2 Drawing Sheets

FIG. 3
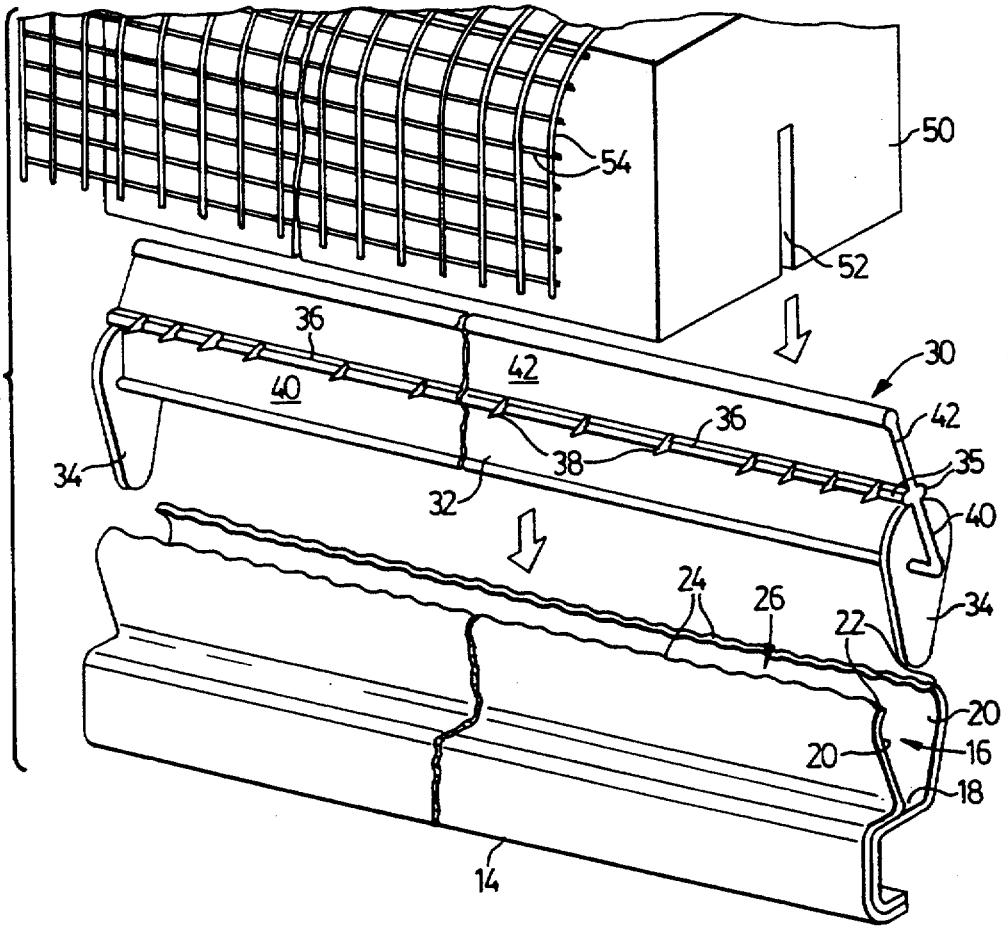
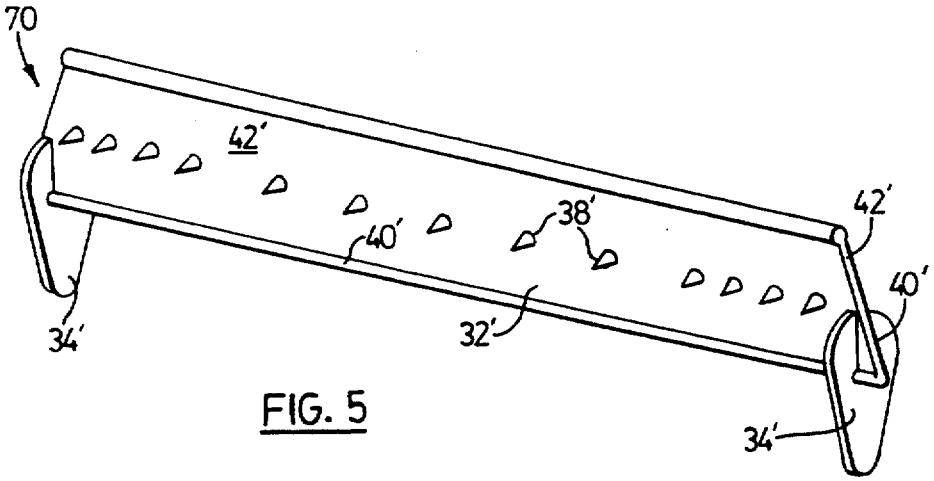
FIG. 5

WINDOW CLEANING DEVICE

RELATED APPLICATIONS

This application is a continuation of application Ser. No. 07/851,731 filed Mar. 16, 1992, now abandoned.

FIELD OF THE INVENTION

The present invention relates to window washing devices.

BACKGROUND OF THE INVENTION

The present window cleaning device is related to the inventions described in earlier U. S. Pat. No. 3,724,017 dated Apr. 3, 1973, and U.S. Pat. No. 4,050,111 dated Sep. 27, 1977. The earlier invention provided a net-like web enveloping the cleaning sponge. The presence of the net enveloping the sponge enhances the cleaning properties of the window washer since the net acts as a scrapper. However, the presence of the net increased the difficulty of securely clamping the sponge to the washer head since as the web encounters surface irregularities and obstructions, a considerable pulling force is exerted on the net which acts to pull the net and sponge out of the channel in which it is mounted. The later invention provided a more secure mount for the sponge and net by providing a pair of continuous shoulders on the sponge stiffener so that the sponge and net was compressed between the shoulders and the side walls of the channel in which the sponge is mounted.

A drawback to this mounting arrangement in that there is a strong tendency for the net and sponge to pulled out of the channel near the ends thereof due to the ends of the sponge and net getting caught on the windshield washers or on pieces of trim. Accordingly, it would be advantageous to provide a sponge and net mount assembly which more strongly anchors the ends of the sponge and net to the window cleaner head.

SUMMARY OF THE INVENTION

A window cleaning device comprises a handle and a head mounted on the handle. The head has a longitudinally elongated channel formed therein, and the channel has an inner wall and spaced opposed side walls, each of the side walls being provided with a flange projecting inwardly therefrom to form a narrow passage therebetween. The device also has a longitudinally elongated sponge with a first end and a second end, and a longitudinally extending mounting portion and a longitudinally extending wiping portion between said first and second ends, as well as a stiffener comprising a stiff, elongate body having opposed first and second faces. The body of the stiffener has a spacer web portion and a stiffener web portion, the mounting portion of the sponge adapted to be deformed around the stiffener. The stiffener has a first set of protrusions comprising a plurality of protrusions longitudinally spaced along the body and projecting transversely outward from the first face and a second set of protrusions comprising a plurality of protrusions longitudinally spaced along the body and projecting transversely outward from the second face. The mounting portion of the sponge, the spacer web and the first set and second set of protrusions, all being receivable within the channel when the mounting portion of the sponge is deformed around the stiffener, the combined transverse length of the protrusions being greater than the width of the narrow passage, such that the sponge is tightly clamped between the first and second sets of protrusions, and the flanges, with the stiffener web having a portion projecting outwardly from said channel into the wiping portion of the sponge to stiffen the wiping portion of the sponge.

There is also a means to tightly clamp the sponge mounting portion when the mounting portion of the sponge, the spacer web and the first and second sets of protrusions are received in said channel, so as to highly compress portions of the mounting portion of the sponge between the first and second sets of protrusions and the said opposed side walls to provide a multiple of highly compressed areas therebetween, and a multiple of less compressed areas adjacent thereto.

When the sponge, stiffener and head are assembled, the sponge mounting portion is deformed around the stiffener with the protrusions disposed within the channel, the portions of the mounting portion of the sponge between the first and second sets of protrusions and the opposed side walls being highly compressed and tightly clamped between the first and second sets of protrusions and the flanges of the side walls of the channel, to resist dislodgment of the sponge mounting portion from the channel in response to multi-directional tensile forces that result from the sponge being caught on windshield washers, pieces of trim or the like, during use.

BRIEF DESCRIPTION OF THE DRAWINGS

The following is a description, by way of example only, of an embodiment of the window cleaning device of the present invention, references being had to the accompanying drawings, in which:

FIG. 3 is a perspective view of the window washing device of FIG. 1 in dissassembled form showing one embodiment of a stiffener forming part of the subject invention;

FIG. 5 is a perspective view of another embodiment of a stiffener forming part of the subject invention.

DETAILED DESCRIPTION OF THE PREFERRED EMBODIMENT

Figure 1:
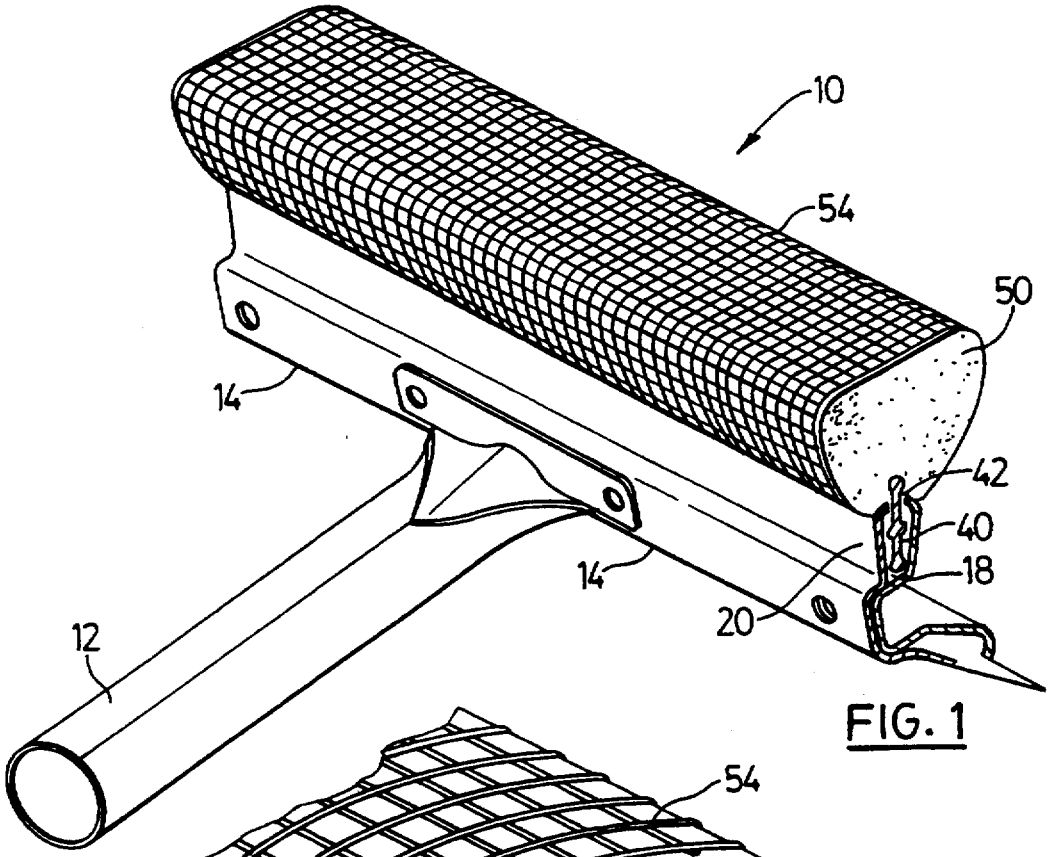
FIG. 1 is perspective view, of a window cleaning device embodying the subject invention.
Figure 2:
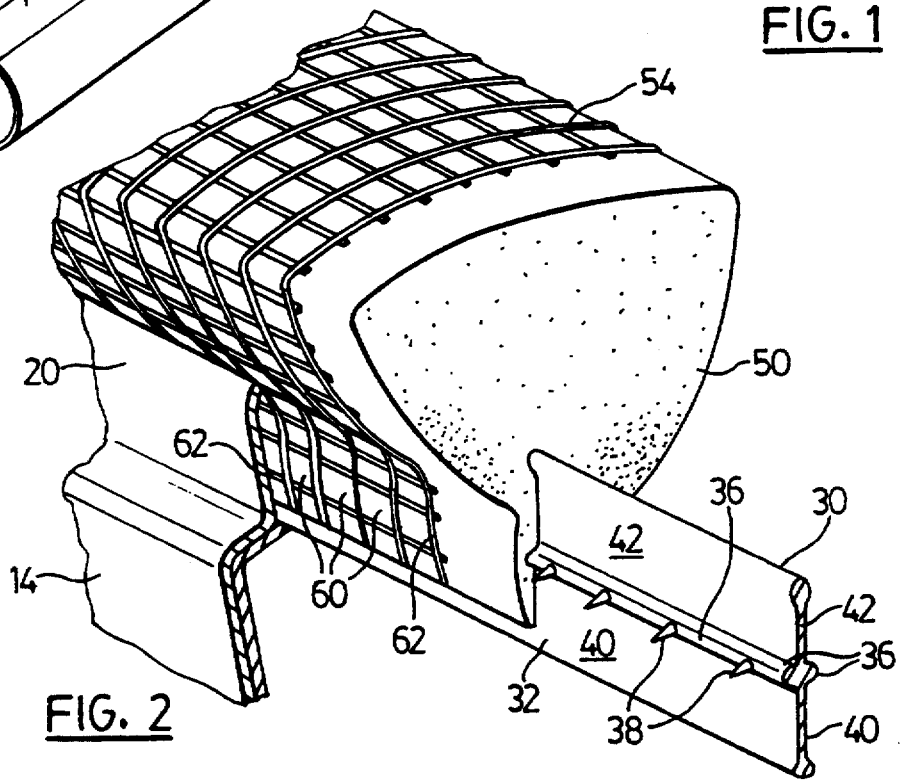
FIG. 2 is a three dimensional cut-away of FIG. 1.

Referring to FIGS. 1 to 3, there is shown a window cleaner 10 having a handle 12 and a head 14 mounted on handle 12. Head 14 is formed to include an elongate channel 16 bounded by an inner wall 18, spaced, opposed sidewalls 20 and a pair of flanges 22 which extend inwardly from the outer peripheral edges of side walls 20. The inner facing edges of flanges 22 include serrations 24. A passage 26 is located between serrated edges of flanges 22.

Window cleaner 10 is provided with a stiffener member 30 having an elongate body 32 extending in a longitudinal direction. Stiffener 30 is provided with end flanges 34 attached generally at the ends of body 32. Stiffener 30 also includes a pair of shoulders 36 projecting transversely outwardly from the sides of elongate body 32 and being integrally formed with body 32. Stiffener 30 is provided with a plurality of spaced teeth or sharp protrusions 38 integrally formed with shoulders 36 and projecting outwardly therefrom. Protrusions 38 are of sufficient sharpness to grip a sponge material. Protrusions 38 are non-uniformly distributed along shoulders 36, being more closely spaced at the ends of body 32 than in the middle portion thereof. Protrusions 38 have a combined transverse extension which is greater than the width of passage 26.

Stiffener 30 is divided in the lateral direction into a spacer web 40 extending downwardly from shoulders 36 along the length of body 32 and a stiffener web 42 projecting upwardly from shoulders 36 along the length of body 32, best seen in FIG. 3. Spacer web 40 is of a suitable length so that when stiffener 30 is located in channel 16 the outer peripheral edge of spacer wed 40 rests on the inner wall 18 and protrusions 38 are located in channel 16 below flanges 22. Similarly, stiffener web 42 is of sufficient length that it extends between flanges 22 into the body of a sponge, see FIG. 3.

Stiffener 30 is preferably fabricated of a suitable plastic, wherein body 32, shoulders 36 and protrusions 38 are molded or injection molded and integrally formed as a unitary structure.

Window washer 10 includes a sponge 50 and in the embodiment shown in FIG. 3 sponge 50 is provided with a slit 52 located in a mounting portion of sponge 50 which acts to receive stiffener web 42 and a portion of spacer web 40, more clearly seen in FIG. 2. A web of net-like material 54 extends over the outer surface of a wiping portion of sponge 50.

Referring again to FIGS. 1 and 2, when window washer 10 is assembled the mounting portion of sponge 50 adjacent slit 52 and web 54 envelops stiffener web 42 and is secured in channel 16 by being clamped between walls 20 and the outer ends of protrusions 38. Flanges 34 are located on the outside of channel 16 and act to locate body 32 in channel 16 and prevent movement of body 32 in channel 16. Protrusions 38 protrude into and are anchored in sponge 50. The plurality of protrusions 38 act to compress multiple portions of sponge between the ends of teeth 38 and walls 22 which creates a plurality of highly compressed sponge areas 60 at these points which are adjacent to less compressed sponge areas 62 into which excess sponge material can flow, see FIG. 2. The sponge at areas 60 is under high pressure between protrusions 38 and wall 20 and is therefore tightly clamped therebetween. The action of protrusions 38 gripping sponge 50 on the interior thereof is to provide a firm anchor so that sponge 50 cannot be removed except by dislodging stiffener 30 from channel 16. This sponge retaining arrangement has been found to be superior to the elongate shoulders in the prior art. Further, at highly compressed areas 60, portions of sponge 50 are forced through the perforations in web 54 thereby producing a positive lock between the sponge and web, similar to a through a hole, which provides increased interlock between sponge 50 and net 54. Protrusions 38 force sponge 50 and web 54 to contort around protrusions 38 as well as around serrations 24 thereby binding sponge 50 and web 54 in place. It has been found that the retention of the combination of net 54 and sponge 50 to head 14 is dramatically improved by use of protrusions 38.

The more closely spaced protrusions along the end portions off body 32 provide a stronger grip for gripping the sponge and web at the ends of head 14 where the sponge and web have a greater probability of being caught and pulled during use. The more widely spaced protrusions in the central region provide for greater ease in handling of stiffener 30 prior to the latter being incorporated into head 14.

Figure 4:
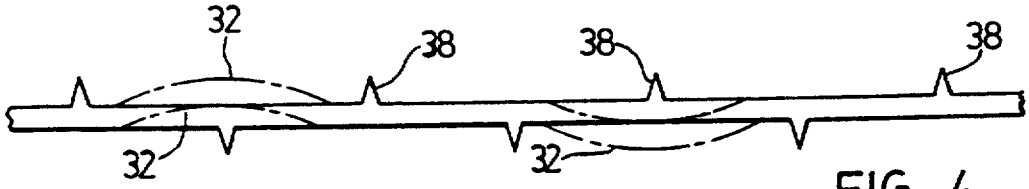
FIG. 4 is a plan view, broken away, of the stiffener shown in FIG. 3.

The plan view shown in FIG. 4 of the stiffener of FIG. 3 shows the protrusions being staggered on either side of body 32. This staggered arrangement facilitates flexing of the stiffener (shown in broken lines) when the stiffener is located in head 14 between walls 20, thereby avoiding further deflection of walls 20. This staggered arrangement also increases the probability that the apertures of web 54 are engaged by portions of the sponge adjacent the protrusions.

Referring to FIG. 5, another embodiment of a stiffener 70 embodying the subject inventions is shown and is similar to stiffener 30 illustrated in FIG. 3 except stiffener 70 is fabricated absent shoulders 36 wherein protrusions 38′ are attached directly to and extend outwardly from elongate body 32′. The longitudinal line of protrusions 38′ divide stiffener 70 into a spacer web 40′ and a stiffener web 42′. In this embodiment protrusions 38′ have a combined transverse extension which is greater than the width of passage 26.

It will be appreciated by those skilled in the art that stiffeners 30 or 70 forming part of the invention disclosed herein may also be retrofitted into modular window washers comprised of components which can be readily assembled and disassembled. In addition, the stiffener disclosed herein may be used on window washing devices absent the web.

While the window washer of the present invention has been described and illustrated with respect to the preferred embodiment, it will be appreciated that numerous variations of these embodiments may be made without departing from the scope of the invention described herein.

What is claimed is:

1. A window cleaning device comprising:

a handle;

a head mounted on said handle, said head having a longitudinally elongated channel formed therein, the channel having an inner wall and spaced opposed side walls, each of the side walls being provided with a flange projecting inwardly therefrom to form a narrow passage therebetween, said narrow passage having a width;

a longitudinally elongated sponge having a first end and a second end, and a longitudinally extending mounting portion and a longitudinally extending wiping portion between said first and second ends;

a stiffener comprising a stiff, elongate body having opposed first and second faces, said body of said stiffener having a spacer web portion and a stiffener web portion, the mounting portion of the sponge adapted to be deformed around the stiffener;

a first set of protrusions comprising a plurality of protrusions longitudinally spaced along the body and projecting transversely outward from said first face;

a second set of protrusions comprising a plurality protrusions longitudinally spaced along the body and projecting transversely outward from said second face;

said mounting portion of said sponge, said spacer wed of said stiffener and said first set and said second set of protrusions, being receivable within said channel when said mounting portion of said sponge is deformed around said stiffener, the combined transverse length of the protrusions being greater than the width of the narrow passage, such that the sponge is tightly clamped between the first and second sets of protrusions and the flanges, said stiffener web projecting outwardly from said channel into the wiping portion of the sponge to stiffen the wiping portion of the sponge;

said spaced opposed side walls define means to tightly clamp said sponge mounting portion when said mounting portion of said sponge, said spacer web of said stiffener, and said first and second sets of protrusions are received said channel, so as to highly compress portions of said mounting portion of said sponge between said first and second sets of protrusions and said opposed side walls to provide a plurality of highly compressed areas therebetween, and a plurality of less compressed areas adjacent thereto;

whereby when the sponge, stiffener and head are assembled, the sponge mounting portion is deformed around the stiffener with said protrusions disposed within said channel, said portions of said mounting portion of said sponge between said first and second sets of protrusions and said opposed side walls being highly compressed and said sponge between said first and second sets of protrusions and the flanges of the side walls of the being tightly clamped, to resist dislodgment of the sponge mounting portion from the channel in response to multi-directional tensile forces that result from said sponge being caught on windshield washers, pieces of trim, and other projections during use.

2. A window cleaning device as claimed in claim 1 further comprising a web-like net having a plurality of apertures, said net enveloping the sponge, said net having a portion receivable in said channel with said mounting portion of said sponge, such that when said net portion and said mounting portion are received in said channel, a plurality of locking portions of said mounting portion of said sponge will be forced through a corresponding number of apertures of said plurality of apertures, to provide a positive lock between the sponge and said net.

3. A window cleaning device as claimed in claim 2, wherein said first set of protrusions is staggered in relation to said second set of protrusions to permit flexing of said stiffener, when said spacer web and said protrusions of said stiffener are tightly clamped in said channel.

4. A window cleaning device as claimed in claim 3, further comprising a pair of flanges, one attached to said elongate body proximate each of one of said first and second ends of said elongated sponge.

5. A window cleaning device as claimed in claim 4 wherein said body, protrusions and flanges of said elongate body are of unitary construction.

6. A window cleaning device as claimed in claim 2, wherein said first set of protrusions is mounted on a first longitudinally extending shoulder and said second set of protrusions is mounted on a second longitudinally extending shoulder.

7. A window cleaning device as claimed in claim 2, wherein said stiffener body has first and second ends and a middle portion, and the protrusions of said first and second sets of protrusions are non-uniformly spaced along the elongate body, the protrusions being more closely spaced proximate the ends of the body than in the middle portion of the body.

8. A window cleaning device as claimed in claim 2 wherein said plurality of highly compressed areas create adequate resistance of the sponge mounting portion, to external tensile forces generally directed in the proximity of said first and second ends.

9. A window cleaning device as claimed in claim 1, wherein said first set of protrusions is staggered in relation to said second set of protrusions to permit flexing of said stiffener, when said spacer web and said protrusions of said stiffener are tightly clamped in said channel.

10. A window cleaning device as claimed in claim 1 wherein said plurality of highly compressed areas create adequate resistance of the sponge mounting portion to external tensile forces generally directed in the proximity of said first and second ends.

11. A window cleaning device as claimed in claim 1 wherein each of said first and second set of protrusions comprises a plurality of sharp protrusions.

12. A window cleaning device as claimed in claim 1 wherein said spacer web portion of said stiffener is in engagement with said inner wall of said channel to prevent movement of the first and second set of protrusions inwardly with respect to the channel.

13. A window cleaning device as claimed in claim 1, wherein said plurality of protrusions of said first and second sets of protrusions are non-uniformly spaced along said first and second faces of said elongate body, said protrusions being more closely spaced toward said first and second ends of the elongated sponge.

14. A window cleaning device as claimed in claim 1 wherein said spacer web of said stiffener is in engagement with said inner channel wall when said spacer web is received in said channel.

15. A window cleaning device as claimed in claim 14, wherein said first set of protrusions is staggered in relation to said second set of protrusions to permit flexing of said stiffener, when said spacer web and said protrusions of said stiffener are tightly clamped in said channel.

* * * * *

UNITED STATES PATENT AND TRADEMARK OFFICE

CERTIFICATE OF CORRECTION

PATENT NO. : 5,371,914

DATED : December 13, 1994

INVENTOR(S) : Mallory et al.

It is certified that error appears in the above-indentified patent and that said Letters Patent is hereby corrected as shown below:

Column 2, line 1, after "protrusions" delete ",".

Column 2, line 2, after "web" delete "having a portion".

Column 2, line 5, delete "There is also a" and insert --The spaced opposed side walls define--.

Column 2, line 11, delete "multiple" and insert --plurality--.

Column 2, line 12, delete "multiple" and insert --plurality--.

Column 2, lines 19-20, delete "tightly clamped" and insert --the sponge--.

Column 2, line 21, after "channel" insert --being tightly clamped--.

Column 4, line 55, after "plurality" insert --of--.

Column 4, line 59, delete "wed" and insert --web--.

Column 5, line 7, after "received" insert --in--.

Column 5, line 23, after "walls of the" insert --channel--.

Signed and Sealed this

Sixteenth Day of May, 1995

*Attest:*

Bruce Lehman

BRUCE LEHMAN

*Attesting Officer*

*Commissioner of Patents and Trademarks*